US009756444B2

(12) United States Patent
Tsingos

(10) Patent No.: US 9,756,444 B2
(45) Date of Patent: Sep. 5, 2017

(54) RENDERING AUDIO USING SPEAKERS ORGANIZED AS A MESH OF ARBITRARY N-GONS

(71) Applicant: DOLBY LABORATORIES LICENSING CORPORATION, San Francisco, CA (US)

(72) Inventor: Nicolas R. Tsingos, Palo Alto, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 31 days.

(21) Appl. No.: 14/780,159

(22) PCT Filed: Mar. 19, 2014

(86) PCT No.: PCT/US2014/031239

§ 371 (c)(1),
(2) Date: Sep. 25, 2015

(87) PCT Pub. No.: WO2014/160576

PCT Pub. Date: Oct. 2, 2014

(65) Prior Publication Data

US 2016/0044433 A1 Feb. 11, 2016

Related U.S. Application Data

(60) Provisional application No. 61/805,977, filed on Mar. 28, 2013.

(51) Int. Cl.
*H04S 3/00* (2006.01)

(52) U.S. Cl.
CPC ..... *H04S 3/002* (2013.01); *H04S 2400/11* (2013.01)

(58) Field of Classification Search
None
See application file for complete search history.

(56) References Cited

U.S. PATENT DOCUMENTS 5,784,467 A 7/1998 Asayama
6,072,878 A 6/2000 Moorer
(Continued)

FOREIGN PATENT DOCUMENTS

CN 1525686 9/2004
CN 1528104 9/2004
(Continued)

OTHER PUBLICATIONS

Pulkki, Ville "Virtual Sound Source Positioning Using Vector Base Amplitude Panning" JAES vol. 45 Issue 6, pp. 456-466, Jun. 1, 1997.
Pernaux, Jean-Marie et al "Virtual Sound Source Positioning and Mixing in 5.1 Implementation on the Real-Time System" IRCAM, Paris France, Nov. 19-21, 1998.
(Continued)

*Primary Examiner* — Quoc D Tran
*Assistant Examiner* — Qin Zhu

(57) ABSTRACT

In some embodiments, a method for rendering an audio program indicative of at least one source, including by panning the source along a trajectory comprising source locations using speakers organized as a mesh whose faces are convex N-gons, where N can vary from face to face, and N is not equal to three for at least one face of the mesh, including steps of: for each source location, determining an intersecting face of the mesh (including the source location's projection on the mesh), thereby determining a subset of the speakers whose positions coincide with the intersecting face's vertices, and determining gains (which may be determined by generalized barycentric coordinates) for speaker feeds for driving each speaker subset to emit sound perceived as emitting from the source location corresponding to the subset. Other aspects include systems configured (e.g., programmed) to perform any embodiment of the method.

20 Claims, 4 Drawing Sheets

(56) References Cited

U.S. PATENT DOCUMENTS

| | | | | |
|---|---|---|---|---|
| 7,061,483 | B2 | 6/2006 | Desbrun | |
| 2004/0008847 | A1 | 1/2004 | Kim | |
| 2006/0045295 | A1 | 3/2006 | Kim | |
| 2006/0171547 | A1 | 8/2006 | Lokki | |
| 2006/0247918 | A1 | 11/2006 | Schmidt | |
| 2007/0255437 | A1* | 11/2007 | Vernon | H04R 29/00 700/94 |
| 2008/0279389 | A1 | 11/2008 | Yoo | |
| 2009/0034764 | A1 | 2/2009 | Ohashi | |
| 2010/0098274 | A1 | 4/2010 | Hannemann | |
| 2010/0119092 | A1* | 5/2010 | Kim | H04R 3/12 381/306 |
| 2011/0305344 | A1 | 12/2011 | Sole | |
| 2012/0113224 | A1 | 5/2012 | Nguyen | |
| 2012/0237062 | A1 | 9/2012 | Korn | |
| 2012/0250869 | A1 | 10/2012 | Ohashi | |
| 2013/0010971 | A1 | 1/2013 | Batke | |

FOREIGN PATENT DOCUMENTS

| | | |
|---|---|---|
| JP | 2010-252220 | 11/2010 |
| WO | 2012/145176 | 10/2012 |
| WO | 2012/164444 | 12/2012 |
| WO | 2013/006330 | 1/2013 |
| WO | 2013/181272 | 12/2013 |

OTHER PUBLICATIONS

Chen, Hung-Kuang et al "A Linear Time Algorithm for High Quality Mesh Simplification" IEEE Sixth International Symposium on Multimedia Software Engineering, Dec. 13-15, 2004, pp. 169-176.

Pulkki, V. et al "Multichannel Audio Rendering Using Amplitude Panning (DSP Applications)" IEEE Signal Processing Magazine, vol. 25, Issue 3, May 2008, pp. 118-122.

Faller, Kenneth II, et al "Acoustic Performance of an Installed Real-Time Three-Dimensional Audio System" Proc. of Meetings on Acoustics 60th Meeting Acoustical Society of America Session, Sep. 15, 2010, pp. 1-13.

Ando, Akio et al Sound Intensity based Three-Dimensional Panning AES Convention paper 7675, presented at the 126th Convention, May 7-10, 2009, Munich, Germany.

Pullki Ville "Spatial Sound Generation and Perception by Amplitude Panning Techniques" Helsinki University of Technology Laboratory of Acoustics and Audio Signal Processing, report 62, Jan. 1, 2001.

Meyer, M. et al "Generalized Barycentric Coordinates on Irregular Polygons" Journal of Graphics Tools, vol. 7, Issue 1, Nov. 2002, pp. 13-22.

Lossius, T. et al "DBAP-Distance-Based Amplitude Panning" Proc. of the International Computer Music Conference (ICMC 2009), Montreal, Canada, Aug. 16-21, 2009.

* cited by examiner

RENDERING AUDIO USING SPEAKERS ORGANIZED AS A MESH OF ARBITRARY N-GONS

CROSS REFERENCE TO RELATED APPLICATIONS

This application claims priority to U.S. Provisional Patent Application No. 61/805,977, filed on 28 Mar. 2013, which is hereby incorporated by reference in its entirety.

TECHNICAL FIELD

The invention relates to systems and methods for rendering an audio program using an array of speakers, where the speakers are assumed to be organized as a mesh whose faces are arbitrary N-gons (polygons) whose vertices correspond to locations of the speakers. Typically, the program is indicative of at least one source, and the rendering includes panning of the source along a trajectory using speakers which are assumed to be organized as a mesh whose faces are arbitrary N-gons whose vertices correspond to locations of the speakers.

BACKGROUND OF THE INVENTION

Sound panning, the process of rendering audio indicative of a sound source which moves along a trajectory for playback by an array of loudspeakers, is a crucial component of typical audio program rendering. In the general case, the loudspeakers can be positioned arbitrarily. Thus, it is desirable to implement sound panning in a manner which accounts properly for the loudspeaker locations in the panning process, where the loudspeakers can have a wide range of loudspeaker positions. Ideally, the panning accounts properly for the positions of loudspeakers of any loudspeaker array, comprising any number of arbitrarily positioned speakers.

In a typical panning implementation, the source trajectory is defined by a set of time varying positional metadata, typically in three dimensional (3D) space using, for instance, a Cartesian (x,y,z) coordinate system. The loudspeaker positions can be expressed in the same coordinate system. Typically, the coordinate system is normalized to a canonical surface or volume.

Given a set of loudspeaker positions and the desired perceived sound source location(s), a panning process may include a step of determining which subset of loudspeakers (of a complete array of loudspeakers) will be used at each instant during the pan to create the proper perceptual image. The process typically includes a step of computing a set of gains, $w_i$, with which the speakers of each subset (assumed to comprise "i" contributing speakers, where i is any positive integer) will playback a weighted copy of a source signal, S, such that the "i" th speaker of the subset is driven by a speaker feed proportional to:

$$L_i = w_i * S, \text{ where } \sum_i w_i^p = 1.$$

The gains are amplitude preserving if p=1, or power preserving if p=2.

Some conventional audio program rendering methods assume that the loudspeakers which will playback the program (e.g., at any instant during a pan) are arranged in a nominally two-dimensional (2D) space relative to a listener (e.g., a listener at the "sweet spot" of the speaker array). Other conventional audio program rendering methods assume that the loudspeakers which will playback the program (e.g., at any instant during a pan) are arranged in a three-dimensional (3D) space relative to a listener (e.g., a listener at the "sweet spot" of the speaker array).

Most conventional approaches to panning (e.g., vector-based amplitude panning or "VBAP") assume that the array of available loudspeakers is structured with the speakers along a circle (a one-dimensional array of speakers) or at the vertices of a 3D triangular mesh (a 3D mesh whose faces are triangles) which approximates a sphere of possible source directions (e.g., the "Sphere" indicated in FIG. 13, which is fitted to the approximate positions of the six speakers shown in FIG. 13). The locations of the speakers of FIG. 13 are expressed relative to a Cartesian coordinate system, with one of the speakers of FIG. 13 at the origin, "(0,0,0)," of such coordinate system. Alternatively, conventional panning methods may express speaker locations relative to a coordinate system of another type (and the origin of the coordinate system need not coincide with the position of any of the speakers).

Herein, a "mesh" of loudspeakers denotes a collection of vertices, edges and faces which defines the shape of a polyhedral structure (e.g., when the mesh is three-dimensional), or whose periphery defines a polygon (e.g., when the mesh is two-dimensional), where each of the vertices is the location of a different one of the loudspeakers. Each of the faces is a polygon (whose periphery is a subset of the edges of the mesh), and each of the edges extends between two vertices of the mesh.

For example, to implement conventional direction-based 2D sound panning (known as "pair-wise panning") with a sound playback system comprising a one-dimensional array of five speakers (e.g., those labeled as speakers 1, 2, 3, 4, and 5 in FIG. 1), the speakers may be assumed to be positioned along a circle centered at the location (location "L" in FIG. 1) of the assumed listener. For example, such a system may assume that speakers 1, 2, 3, 4, and 5 of FIG. 1, are positioned so as to be at least substantially equidistant from listener position L. To playback an audio program so that the sound emitted from the speakers is perceived as emitting from an audio source at a source location (relative to the listener) in the plane of the speakers (location "S" of FIG. 1), the two speakers spanning the source location (i.e., the two speakers nearest to the source location, and between which the source location occurs) may be determined, and gains to be applied to the speaker feeds for these two speakers may then be determined to cause the sound emitted from the two speakers to be perceived as emitting from the source location. For example, speakers 1 and 2 of FIG. 1 span the source location S, and the a typical conventional method would determine the gains to be applied to the speaker feeds for speakers 1 and 2 to cause the sound emitted from these speakers to be perceived as emitting from source location S. During a pan, as the source location moves (along a trajectory along the circle defined by the assumed speaker locations) relative to the listener, a typical conventional method may determine gains to be applied to the speaker feeds for each of a sequence of pairs of the available speakers.

For another example, to implement a typical type of conventional direction-based 3D sound panning (known as vector-based amplitude panning or "VBAP") with a sound playback system comprising seven speakers (e.g., those labeled as speakers 10, 11, 12, 13, 15, 16, and 17 in FIG. 2), the speakers are assumed to be structured as a convex 3D mesh, whose faces are triangles, and enclosing the location (location "L" in FIG. 2) of the assumed listener. For example, the panning method may assume that the speakers 10, 11, 12, 13, 15, 16, and 17 of FIG. 2, are arranged in a mesh of triangles, with three of the speakers at the vertices of each of the triangles as shown in FIG. 2. To playback an audio program so that the sound emitted from the speakers is perceived as emitting from an audio source at a source location (location "S" in FIG. 2) relative to the listener, the triangle which includes the projection (location "S1" in FIG. 2) of the source location on the mesh (i.e., the triangle intersected by the ray from the listener location L to the source location S) may be determined. Then, the gains to be applied to the speaker feeds for the three speakers at the vertices of this triangle may be determined to cause the sound emitted from these three speakers to be perceived as emitting from the source location. For example, speakers 10, 11, and 12 of FIG. 2 are located at the vertices of the triangle which includes the projection (location "S1" in FIG. 2) of source location S on the mesh, and an example of such a method would determine the gains to be applied to the speaker feeds for speakers 10, 11, and 12 to cause the sound emitted from them to be perceived as emitting from source location S. During a pan, as the source location moves (along a trajectory projected on the mesh) relative to the listener, a typical conventional method may determine gains to be applied to the speaker feeds for each triplet of speakers at the vertices of each triangle, of a sequence of triangles, which includes the current projection of the source location on the mesh.

However, conventional directional panning methods are not optimal for implementing many types of sound pans, and do not support speakers which are arbitrarily located inside the listening volume or region. Other conventional panning methods, such as distance-based amplitude panning (DBAP), are position-based, and rely on a direct distance measure between each loudspeaker and the desired source location to compute panning gains. They can support arbitrary speaker arrays and panning trajectories but tend to cause too many speakers to be fired at the same time, which leads to timbral degradation. Conventional VBAP panning methods cannot stably implement pans in which a source moves along any of many common trajectories. For instance, source trajectories (which cross the volume defined by the mesh of speakers) near the "sweetspot" can induce fast direction changes (of the source position relative to the assumed listener position at the sweetspot) and therefore abrupt gain variations. For example, during pans along many typical source trajectories, especially when the mesh comprises elongated speaker triangles, a conventional VBAP method may drive pairs of speakers (i.e., only two speakers at a time) during at least part of the pan's duration, and/or the positions of consecutively driven pairs or triplets of speakers may undergo sudden, large changes during at least part of the pan's duration which are perceivable and distracting to listeners. For example, the driven speakers may comprise a rapid succession of: two speakers separated by a small distance, and then another pair of speakers separated by a much larger distance, and then another pair of speakers separated by a relatively small distance, and so on. Such unstable panning implementations (implementations which are perceived as being unstable) may be especially common when the pan is along a diagonal source trajectory relative to the listener (e.g., where the source moves both to the left and/or right, and the front and/or back, of the room enclosing the speakers and the listener).

Another type of audio rendering is described in PCT International Application No. PCT/US2012/044363, published under International Publication No. WO 2013/006330 A2 on Jan. 10, 2013, and assigned to the assignee of the present application. This type of rendering may assume an array of loudspeakers organized into several two-dimensional planar layers (horizontal layers) at different elevations. The speakers in each horizontal layer are axis-aligned (i.e., each horizontal layer comprises speakers organized into rows and columns, with the columns aligned with some feature of the listening environment, e.g., the columns are parallel to the front-back axis of the environment). For example, speakers 20, 21, 22, 23, 24, 25, 26, 27, 28, 29, 30, and 31 of FIG. 3 (or FIG. 4 or 5) are the speakers of one horizontal layer of an example of such an array. Speakers 20-31 (of FIG. 3, 4, or 5) are organized into five rows (e.g., one row including speakers 20, 21, and 22, and another row including speakers 31 and 23) and five columns (e.g., one column including speakers 29, 30, and 31, and another column including speakers 20 and 28). Speakers 20, 21, and 23 may be positioned along the front wall of a room (e.g., a theater) near the ceiling, and speakers 26, 27, and 28 may be positioned along the room's rear wall (also near the ceiling). A second set of twelve speakers may be positioned in a lower horizontal layer (e.g., near the floor of the room). Thus, in the example of FIGS. 3-5, the entire array of speakers (including each horizontal layer of speakers) defines a rectangular mesh of speakers which encloses the assumed position of a listener (e.g., a listener assumed to be at the speaker array's "sweet spot").

The entire array of speakers (including each horizontal layer of speakers) also defines a conventional convex 3D mesh of three-speaker (triangular) groups of speakers, which also encloses the assumed position of a listener (e.g., the "sweet spot"), with each face of the mesh being a triangle whose vertices coincide with the positions of three of the speakers. Such a conventional convex 3D mesh made of triangular groups of speakers is of the same type described with reference to FIG. 2.

To image an audio source at a source location outside the speaker array (e.g., outside the mesh of FIGS. 3-5), sometimes referred to as a "far-field" source location, PCT International Application No. PCT/US2012/044363 teaches using a conventional VBAP panning method (or a conventional wave field synthesis method). Such a conventional VBAP method is of the type described with reference to FIG. 2, and assumes that the speakers are organized as a conventional convex 3D mesh made of triangular groups of speakers (of the type described with reference to FIG. 2). To render an audio program (indicative of the source) so that the sound emitted from the speakers is perceived as emitting from the source at the desired far-field source location, the triangular face (triangle) which includes the projection of the source location on the triangular mesh is determined. Then, the gains to be applied to the speaker feeds for the three speakers at the vertices of this triangle are determined to cause the sound emitted from these three speakers to be perceived as emitting from the source location. Such a far-field source can be imaged by the conventional VBAP method as it is panned along a far-field trajectory projected on the 3D triangular mesh. Another alternative is to apply a 2D directional pair-wise panning method (e.g., such as that mentioned with reference to FIG. 1) in each one of the 2D layers and combine the resulting speaker gains as a function of the source elevation (z coordinate).

PCT International Application No. PCT/US2012/044363 also teaches performance of a "dual-balance" panning method to render an audio source at a source location inside the speaker array (e.g., inside the mesh of FIGS. 3-5), sometimes referred to as a "near-field" source location. The dual-balance panning method is a positional panning approach rather than a directional panning approach. It assumes that the speakers are organized in a rectangular array (comprising horizontal layers of speakers) which encloses the assumed position of the listener. However, the dual-balance panning method does not determine the projection of the source location on a rectangular face of this array, followed by determination of gains to be applied to speaker feeds for the speakers at the vertices of such a face to cause the sound emitted from the speakers to be perceived as emitting from the source location.

Rather, the dual-balance panning method determines, for each near-field source location, a set of left-to-right panning gains (i.e., a left-to-right gain for each speaker of one of the horizontal layers of the speaker array) and a set of front-to-back panning gains (i.e., a front-to-back gain for each speaker of same horizontal layer of the array). The method multiplies the front-to-back panning gain for each speaker of the layer (for each near-field source location) by the left-to-right panning gain for the speaker (for the same near-field source location) to determine (for each near-field source location) a final gain for each speaker of the horizontal layer. To implement a pan of the source by driving the speakers of the horizontal layer, a sequence of final gains is determined for each speaker of the layer, each of the final gains being the product of one of the front-to-back panning gains and a corresponding one of the left-to-right panning gains.

To render an arbitrary horizontal pan through a sequence of near-field source locations using the speakers in one horizontal plane (e.g., a pan indicative of motion of a source location relative to the listener along an arbitrary near-field trajectory projected on the horizontal plane, e.g., the trajectory of source S shown in FIG. 5), the method would typically determine a sequence of left-to-right panning gains (one left-to-right panning gain for each source location) to be applied to the speaker feeds for the speakers in the horizontal plane. For example, left-to-right panning gains for a source position S as shown in FIG. 3, may be computed for two speakers of each row of the speakers (in the horizontal plane of the source position) which includes speakers of two columns (of the speakers in the plane) enclosing the source position (e.g., for speakers 20 and 21 of the first row, speakers 31 and 23 of the second row, speakers 30 and 24 of the third row, speakers 29 and 25 of the fourth row, and speakers 28 and 27 of the back row, with the left-to-right panning gain for speakers 22 and 26 being set to zero). The method would typically also determine a sequence of front-to-back panning gains (one front-to back panning gain for each source location) to be applied to the speaker feeds for the speakers in the horizontal plane. For example, the front-to back panning gains for a source position S as shown in FIG. 4, may be computed for two speakers of each of the two rows of the speakers in the plane enclosing the source position (e.g., for speakers 30 and 31 of the left column, and for speakers 23 and 24 of the right column, with the front-to back panning gain for speakers 20, 21, 22, 25, 26, 27, 28, and 29 being set to zero). The sequence of gains ("final gains") to be applied to the speaker feed for each speaker of the horizontal plane (to render the arbitrary horizontal pan) would then be determined by multiplying the front-to-back panning gains for the speaker by the left-to-right panning gains for the speaker (so that each final gain in the sequence of final gains is the product of one of the front-to-back panning gains and a corresponding one of the left-to-right panning gains).

To render an arbitrary pan (along a 3D "near-field" trajectory anywhere within the rectangular array) using the speakers in all horizontal planes of the rectangular mesh (e.g., a pan indicative of motion of a source location relative to a listener along an arbitrary 3D near-field trajectory within the mesh), gains for speaker feeds of the speakers in each horizontal plane of the mesh could be determined by dual-balance panning as described in the previous paragraph, for the projection (on the horizontal plane) of the source trajectory. Then, using the projection (on a vertical plane) of the source trajectory, a sequence of "elevation" weights would be determined for the gains for the speakers of each horizontal plane (e.g., so that the elevation weights are relatively high for a horizontal plane when the trajectory's projection, on the vertical plane, is in or near to the horizontal plane, and the elevation weights are relatively low for a horizontal plane when the trajectory's projection, on the vertical plane, is far from the horizontal plane). The sequence of gains ("final gains") to be applied to the speaker feed for each speaker of each of the horizontal planes of the rectangular mesh (to render the arbitrary 3D pan) could then be determined by multiplying the gains for the speaker in each layer by the elevation weights.

For example, the dual-balance panning method could render an arbitrary pan along a 3D "near-field" trajectory anywhere within a rectangular array of speakers (of the type described with reference to FIGS. 3-5) including a set of "ceiling" speakers (in a top horizontal plane) and at least one set of lower (e.g., wall or floor) speakers (each set of lower speakers positioned in a horizontal plane below the top horizontal plane) in a theater. To pan in a vertical plane parallel to a side wall of the theater, the rendering system could pan through the ceiling speakers (i.e., render sound using a sequence of subsets of only the ceiling speakers) until an inflection point (a specific distance away from the movie screen, toward the rear wall) is reached. Then, a blend of ceiling and lower speakers could be used to continue the pan (so that the source is perceived as dipping downward as it moves to the rear of the theater). The blending between base and ceiling is not driven by a distance to the screen but by the Z coordinate of the source (and the Z coordinate of each 2D layer of speakers).

The described dual-balance panning method assumes a specific arrangement of loudspeakers (speakers arranged in horizontal planes, with the speakers in each horizontal plane arranged in rows and columns). Thus, it is not optimal for implementing sound panning using arbitrary arrays of loudspeakers (e.g., arrays which comprises any number of arbitrarily positioned speakers). Further, the dual-balance panning method does not assume that the speakers are organized as a mesh of polygons, and determine the projection of a source location (e.g., each of a sequence of source locations) on a face of such a mesh, and gains to be applied to the speaker feeds for the speakers at the vertices of such a face to cause the sound emitted from the speakers to be perceived as emitting from the source location. Rather than implementing efficient determination of only a gain for each speaker at a vertex of one polygonal face (of a speaker array organized as a mesh) and driving of only the speakers at the vertices of one such face (at any instant) to image a source at a source location, the dual-balance method determines gains (front-to-back and left-right panning gains) for all speakers of at least one horizontal plane of speakers of such an array and drives all speakers for which both the front-to-back and left-right panning gains are nonzero (at any instant).

Some embodiments of the present invention are directed to systems and methods that render audio programs that have been encoded by a type of audio coding called audio object coding (or object based coding or "scene description"). They assume that each such audio program (referred to herein as an object based audio program) may be rendered by any of a large number of different arrays of loudspeakers. Each channel of such object based audio program may be an object channel. In audio object coding, audio signals associated with distinct sound sources (audio objects) are input to the encoder as separate audio streams. Examples of audio objects include (but are not limited to) a dialog track, a single musical instrument, and a jet aircraft. Each audio object is associated with spatial parameters, which may include (but are not limited to) source position, source width, and source velocity and/or trajectory. The audio objects and associated parameters are encoded for distribution and storage. Final audio object mixing and rendering may be performed at the receive end of the audio storage and/or distribution chain, as part of audio program playback. The step of audio object mixing and rendering is typically based on knowledge of actual positions of loudspeakers to be employed to reproduce the program.

Typically, during generation of an object based audio program, the content creator may embed the spatial intent of the mix (e.g., the trajectory of each audio object determined by each object channel of the program) by including metadata in the program. The metadata can be indicative of the position or trajectory of each audio object determined by each object channel of the program, and/or at least one of the size, velocity, type (e.g., dialog or music), and another characteristic of each such object.

During rendering of an object based audio program, each object channel can be rendered ("at" a time-varying position having a desired trajectory) by generating speaker feeds indicative of content of the channel and applying the speaker feeds to a set of loudspeakers (where the physical position of each of the loudspeakers may or may not coincide with the desired position at any instant of time). The speaker feeds for a set of loudspeakers may be indicative of content of multiple object channels (or a single object channel). The rendering system typically generates the speaker feeds to match the exact hardware configuration of a specific reproduction system (e.g., the speaker configuration of a home theater system, where the rendering system is also an element of the home theater system).

In the case that an object based audio program indicates a trajectory of an audio object, the rendering system would typically generate speaker feeds for driving an array of loudspeakers to emit sound intended to be perceived (and which typically will be perceived) as emitting from an audio object having said trajectory. For example, the program may indicate that sound from a musical instrument (an object) should pan from left to right, and the rendering system might generate speaker feeds for driving a 5.1 array of loudspeakers to emit sound that will be perceived as panning from the L (left front) speaker of the array to the C (center front) speaker of the array and then the R (right front) speaker of the array.

BRIEF DESCRIPTION OF THE INVENTION

In a class of embodiments, the invention is a method for rendering an audio program indicative of at least one source, including by generating speaker feeds for causing an array of loudspeakers to pan the source along a trajectory comprising a sequence of source locations, said method including steps of:

(a) determining a mesh whose faces, $F_i$, are convex N-gons, where positions of the N-gons' vertices correspond to locations of the loudspeakers, i is an index in the range $1 \le i \le M$, M is an integer greater than 2, each of the faces, $F_i$, is a convex polygon having $N_i$ sides, $N_i$ is any integer greater than 2, and $N_i$ is greater than 3 for at least one of the faces; and (b) determining a sequence of projections of the source locations on a sequence of faces of the mesh, and determining a set of gains for each subset of the loudspeakers whose locations correspond to positions of vertices of each face of the mesh in the sequence of faces.

In some embodiments, step (a) includes steps of: determining an initial mesh whose faces are triangular faces, wherein the positions of the vertices of the triangular faces correspond to the locations of the loudspeakers; and replacing at least two of the triangular faces of the initial mesh by at least one replacement face which is a non-triangular, convex N-gon, thereby generating the mesh.

In some embodiments, the loudspeaker locations are in a set of 2D layers, and each source location is a "near field" location within the mesh, and the projections determined in step (b) are directly orthogonal projections onto the 2D layers. In some embodiments, each source location is a "far field" location outside the mesh, the mesh is a polygonized "sphere" of speakers, and the projections determined in step (b) are directional projections onto the polygonized sphere of speakers.

The convex N-gons of the mesh are typically convex, planar N-gons, and the positions of their vertices correspond to the locations of the loudspeakers (each vertex corresponds to the location of a different one of the speakers). For example, the mesh may be a two-dimensional (2D) mesh or a three-dimensional (3D) mesh, where some of the mesh's faces are triangles and some of the mesh's faces are quadrilaterals. The mesh structure can be user defined, or can be computed automatically (e.g., by a Delaunay triangulation of the speaker positions or their convex hull to determine a mesh whose faces are triangles, followed by replacement of some of the triangular faces, determined by the initial triangulation, by non-triangular, convex N-gons).

In some embodiments, the invention is a method for rendering an audio program indicative of at least one source, including by panning the source along a trajectory comprising a sequence of source locations, using an array of loudspeakers assumed to be organized as a mesh whose faces, $F_i$, are convex N-gons, where positions of the N-gons' vertices correspond to locations of the loudspeakers, i is an index in the range $1 \le i \le M$, M is an integer greater than 2, each of the faces, $F_i$, is a convex polygon having $N_i$ sides, $N_i$ is any integer greater than 2, and $N_i$ is greater than 3 for at least one of the faces, said method including steps of:

(a) for each of the source locations, determining an intersecting face of the mesh, where the intersecting face includes the projection of the source location on the mesh, thereby determining for each said intersecting face, a subset of the speakers whose positions coincide with the intersecting face's vertices; and (b) determining gains for each said subset of the speakers, such that when speaker feeds are generated by applying the gains to audio samples of the audio program and the subset of the speakers is driven by the speaker feeds, the subset of the speakers will emit sound which is perceived as emitting from the source location corresponding to the subset of the speakers. Typically, the method also includes a step of generating a set of speaker feeds for each said subset of the speakers, including by applying the gains determined in step (b) for the subset of the speakers to audio samples of the audio program.

Typically, the N-gons are planar polygons, and step (b) includes a step of computing generalized barycentric coordinates of each said projection of the source location, with respect to vertices of the intersecting face for the projection. In some embodiments, the gains determined in step (b) for each said subset of the speakers are the generalized barycentric coordinates of the projection of the source location with respect to the vertices of the intersecting face which corresponds to said subset of the speakers. In some embodiments, the gains determined in step (b) for each said subset of the speakers are determined from the generalized barycentric coordinates of the projection of the source location with respect to the vertices of the intersecting face which corresponds to said subset of the speakers.

In a class of embodiments, the invention is a method for rendering an audio program indicative of at least one source, including by panning the source along a trajectory comprising a sequence of source locations, using an array of speakers organized as a mesh (a 2D or 3D mesh, e.g., a convex 3D mesh) whose faces are convex (and typically, planar) N-gons, where N can vary from face to face, N is greater than three for at least one face of the mesh, and the mesh encloses an assumed listener location, said method including steps of:

(a) for each of the source locations, determining an intersecting face of the mesh, where the intersecting face includes the projection of the source location on the mesh, thereby determining, for each said intersecting face, a subset of the speakers whose positions coincide with the intersecting face's vertices; and (b) determining gains for each said subset of the speakers; and (c) generating a set of speaker feeds for each said subset of the speakers, including by applying the gains determined in step (b) for the subset of the speakers to audio samples of the audio program, such that when the subset of the speakers is driven by the speaker feeds, said subset of the speakers will emit sound which is perceived as emitting from the source location corresponding to said subset of the speakers.

In some embodiments, the mesh structure of the array of speakers is computed by triangulation of the speaker positions (or their convex hull) to determine an initial mesh whose faces are triangles (with the speaker positions coinciding with the triangle vertices), followed by replacement of at least one (e.g., more than one) of the triangular faces of the initial mesh by non-triangular, convex (and typically, planar) N-gons (e.g., quadrilaterals) with the speaker positions coinciding with the vertices of the N-gons. Faces of the initial mesh which are elongated triangles are not well suited to typical panning, and may be collapsed into quadrilaterals by removing edges shared with their neighbors from the initial mesh, resulting in a more uniform panning region.

To avoid unstable implementations (implementations which are perceived as being unstable) of a pan, e.g., along a diagonal source trajectory relative to a listener (e.g., where the speakers and listener are in a room, and the pan trajectory extends both toward the left (or right) of the room and the back (or front) of the room), some embodiments of the invention determine the mesh structure of the array of speakers as follows. An initial mesh structure of the array of speakers is computed by triangulation of the speaker positions (or their convex hull). The faces of the initial mesh are triangles whose vertices coincide with the speaker positions. Then, some of the triangular faces of the initial mesh are replaced by convex, non-triangular N-gons (e.g., quadrilaterals) whose vertices coincide with speaker positions. For example, triangular faces (of the initial mesh) that cover the left side and right side of the panning area/volume in a non-uniform manner may be merged into quadrilateral faces (or faces which are other non-triangular N-gons) that cover the left and right sides of the panning area/volume more uniformly. For example, for each triangle of the initial mesh, the area of the triangle which is to the left of the sweetspot (e.g., the center of the mesh bounding volume) can be computed and compared to the area of the triangle which is to the right of the sweetspot. If a triangle extends both to the left and right sides of the sweetspot, and the portion of its area to the left of the sweet spot is very different from the portion of its area to right of the sweet spot, then the triangle may be collapsed into a non-triangular N-gon which is more uniform with respect to the sweet spot.

In some embodiments, an array of speakers is assumed to be organized as a mesh whose vertices coincide with the speaker locations (during rendering of an audio program including by determining, for each source location, an intersecting face of the mesh which includes the projection of the source location on the mesh), but the structure of the mesh is not determined by modification of an initial mesh. Instead, the mesh is an initial mesh which includes at least one face which is a non-triangular, convex (and typically, planar) N-gon (e.g., a quadrilateral), with the vertices of the N-gon coinciding with speaker locations.

In typical embodiments of the invention, to render a pan of a sound source through a sequence of (2D or 3D) apparent source positions using an array of speakers organized as a mesh of polygons (polygonal faces), which includes at least one face which is a non-triangular, convex (and typically, planar) N-gon (whose vertices coincide with speaker positions), the contributing N-gon at any instant during the pan (the face of the mesh to be driven at such instant) is determined (e.g., by testing) to be the polygon of the mesh which satisfies the following criterion: a ray connecting an assumed listener position (e.g., sweetspot) to the target source position (at the instant) intersects the contributing N-gon or a region enclosed by the contributing N-gon. Typically, if a ray connecting an assumed listener position to a target source position intersects two of the faces of the mesh (i.e., the ray intersects an edge between two faces) at an instant, only one of these faces is selected as the contributing N-gon at the instant.

For each vertex of each N-gon of the mesh which is selected to be a contributing N-gon (and thus for each speaker whose position coincides with one of these vertices), and in the case that the contributing N-gon is a planar N-gon, a gain is typically determined by computing the generalized barycentric coordinates with respect to the contributing N-gon of the target source point (i.e., of the intersection point of a ray, from the listener position to the target source point, and the contributing N-gon or a point within the contributing N-gon. The barycentric coordinates, $b_i$ (where i is an index in the range $1 \leq i \leq N$), or their powers (e.g., $b_i^2$), or renormalized versions thereof (to preserve power or amplitude), can be used as panning gains. For another example, barycentric coordinates, $b_i$, are determined for each target source point in accordance with any embodiment of the invention, and modified versions of the barycentric coordinates (e.g., $f(b_i)$, where "$f(b_i)$" denotes some function of value $b_i$) are used as panning gains. For example, the function $f(b_i)$ could be $f(b_i)=(b_i)^p$, where p is some number (typically, p would be in the range between 1 and 2).

If the contributing N-gon is a non-planar N-gon (e.g., a quadrilateral which is substantially planar but not exactly planar), a gain for each vertex of the contributing N-gon is similarly determined, e.g., by a variation on a conventional method of computing generalized barycentric coordinates, or by splitting the non-planar N-gon into planar N-gons or fitting a planar N-gon to it and then determining generalized barycentric coordinates for the planar N-gon(s).

Aspects of the invention include a system configured (e.g., programmed) to perform any embodiment of the inventive method, and a computer readable medium (e.g., a disc) which stores code for implementing any embodiment of the inventive method.

In typical embodiments, the inventive system is or includes a general or special purpose processor programmed with software (or firmware) and/or otherwise configured to perform an embodiment of the inventive method. In some embodiments, the inventive system is or includes a general purpose processor, coupled to receive input audio, and programmed (with appropriate software) to generate (by performing an embodiment of the inventive method) output audio in response to the input audio. In other embodiments, the inventive system is implemented to be or include an appropriately configured (e.g., programmed and otherwise configured) audio digital signal processor (DSP) which is operable to generate gain values for generating speaker feeds (and/or data indicative of speaker feeds) in response to input audio.

Figures 3, 4, 5:
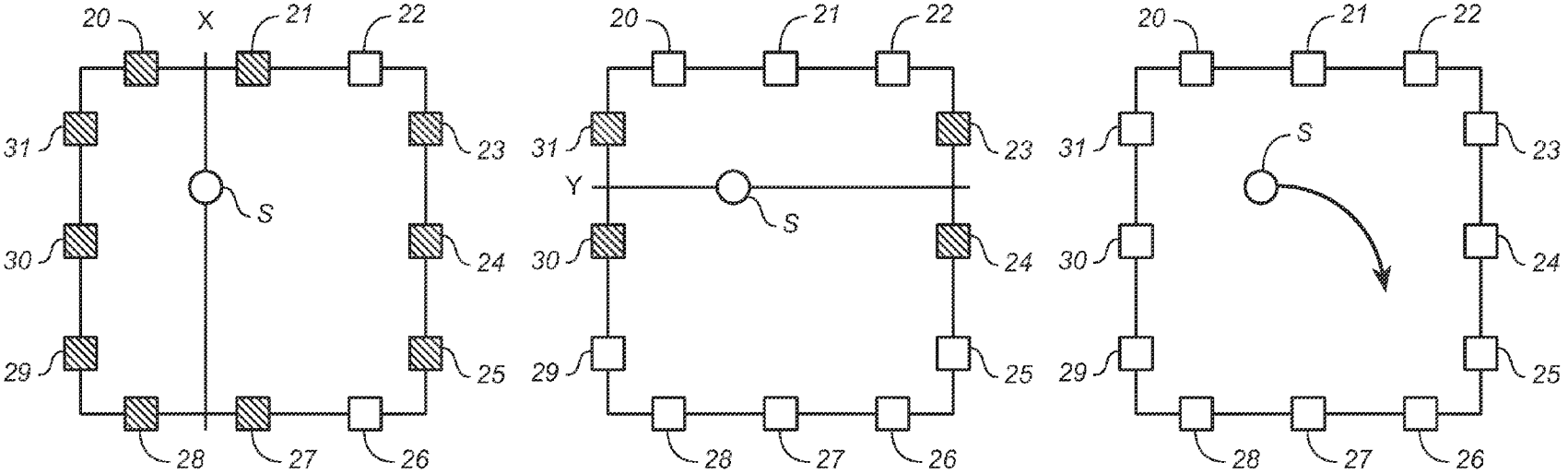
FIG. 3 (PRIOR ART)
FIG. 4 (PRIOR ART)
FIG. 5 (PRIOR ART)

Each of FIG. 3, FIG. 4, and FIG. 5, is a diagram of one horizontal layer of a 3D rectangular mesh of speakers, of a type assumed by a conventional method for 3D sound panning.

Figure 6:
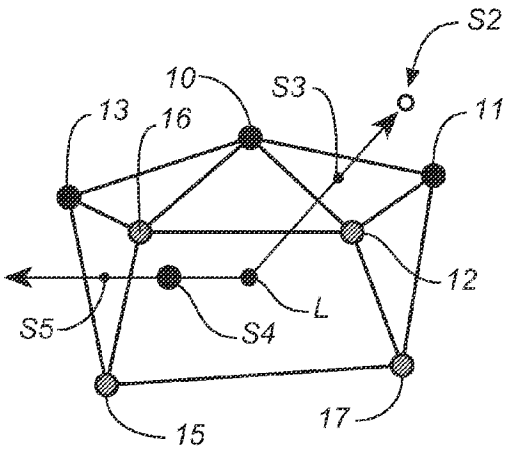

FIG. 6 is a diagram of a three-dimensional (3D) mesh of speakers assumed by an embodiment of the inventive method for 3D sound panning.

Figure 7:
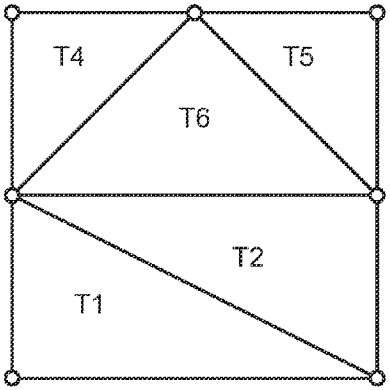

FIG. 7 is a diagram of a triangular mesh of speakers assumed by a conventional method for sound panning.

Figure 8A:
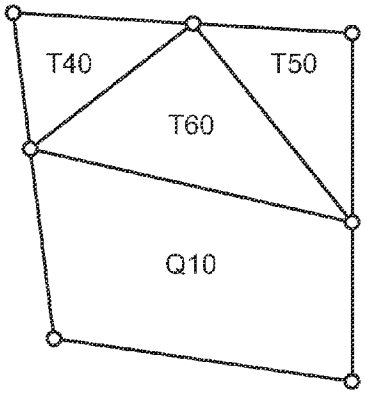
Figure 8:
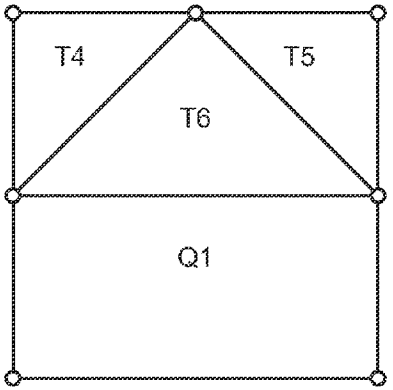

FIG. 8 is a diagram of a mesh of speakers (a modified version of the FIG. 7 mesh) assumed by an embodiment of the inventive method for sound panning.

FIG. 8A is a diagram of a mesh of speakers assumed by another embodiment of the inventive method for sound panning.

Figure 9:
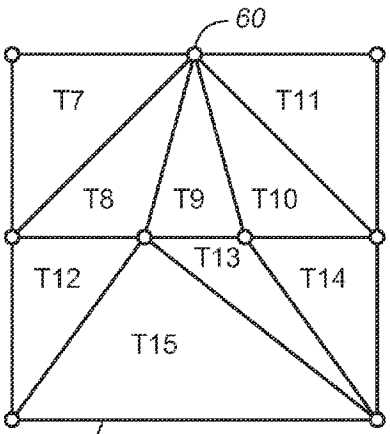

FIG. 9 is a diagram of a triangular mesh of speakers assumed by a conventional method for sound panning.

Figure 10:
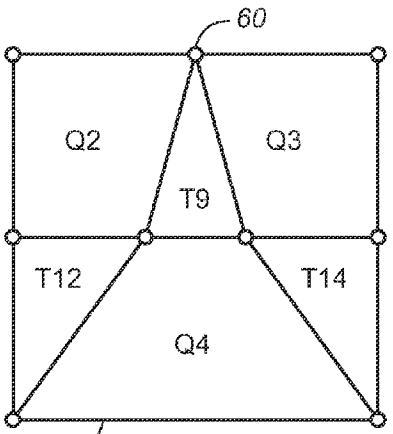

FIG. 10 is a diagram of a mesh of speakers (a modified version of the FIG. 9 mesh) assumed by an embodiment of the inventive method for sound panning.

Figure 11:
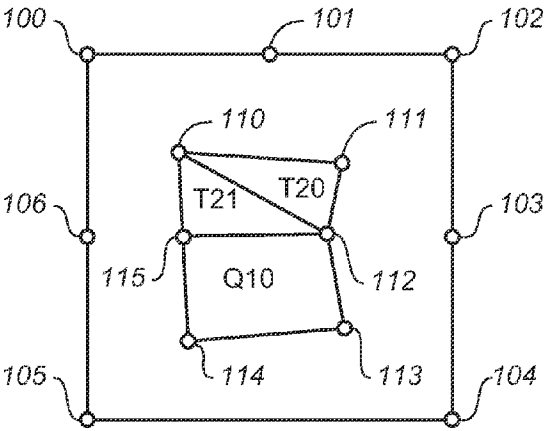

FIG. 11 is a diagram of an array of speakers including axis-aligned speakers 100, 101, 102, 103, 104, 105, and 106 (positioned on the floor of a room), and speakers 110, 111, 112, 113, 114, and 115 (which are positioned on the ceiling of the room but are not axis-aligned). In accordance with an embodiment of the invention, speakers 110-115 are organized as a mesh of speakers whose faces include triangular faces T20 and T21, and quadrilateral faces Q10.

Figure 12:
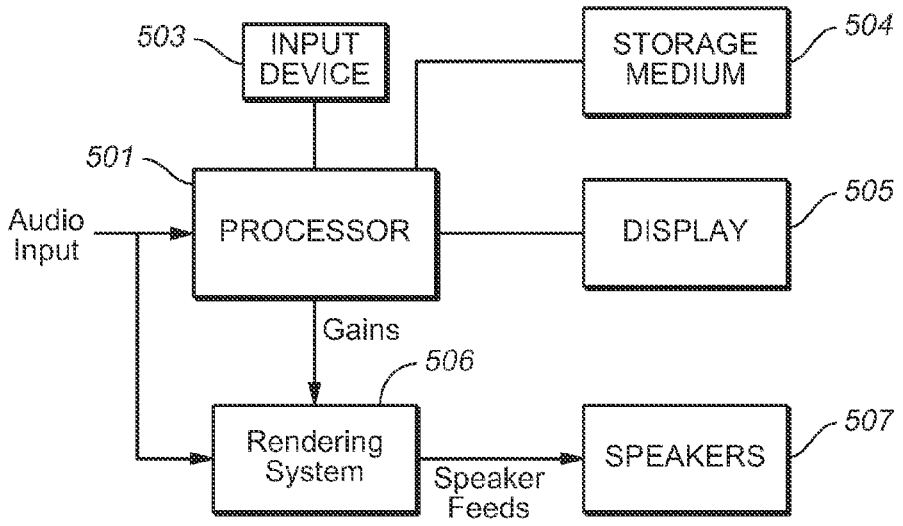

FIG. 12 is a block diagram of a system, including a computer readable storage medium 504 which stores computer code for programming processor 501 of the system to perform an embodiment of the inventive method.

Figure 13:
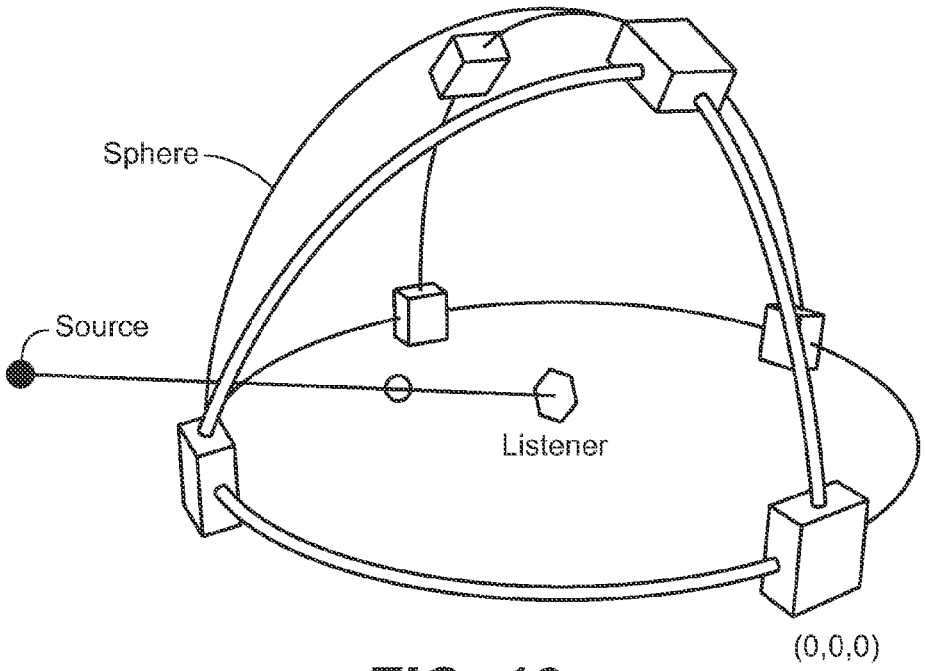
FIG. 13 (PRIOR ART)

FIG. 13 is a diagram of a 3D mesh of six speakers of a type assumed by a conventional (VBAP) method for sound panning. The sphere ("Sphere") indicated in FIG. 13 is fitted to the approximate positions of the six speakers.

Notation and Nomenclature

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expressions "audio processor" and "audio processing unit" are used interchangeably, and in a broad sense, to denote a system configured to process audio data. Examples of audio processing units include, but are not limited to encoders (e.g., transcoders), decoders, codecs, pre-processing systems, post-processing systems, and bitstream processing systems (sometimes referred to as bitstream processing tools).

Throughout this disclosure including in the claims, the expression "metadata" (e.g., as in the expression "processing state metadata") refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the expression "barycentric coordinates" of a point in (enclosed by) or on a convex, planar N-gon, is used in the well known, conventional sense (e.g., as defined in Meyer, et al., "Generalized Barycentric Coordinates on Irregular Polygons," Journal of Graphics Tools, Vol. 7, Issue 1, November 2002, pp. 13-22).

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;

audio program: a set of one or more audio channels (at least one speaker channel and/or at least one object channel) and optionally also associated metadata (e.g., metadata that describes a desired spatial audio presentation);

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description. The source description may determine sound emitted by the source (as a function of time), the apparent position (e.g., 3D spatial coordinates) of the source as a function of time, and optionally at least one additional parameter (e.g., apparent source size or width) characterizing the source;

object based audio program: an audio program comprising a set of one or more object channels (and optionally also comprising at least one speaker channel) and optionally also associated metadata that describes a desired spatial audio presentation (e.g., metadata indicative of a trajectory of an audio object which emits sound indicated by an object channel); and render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis.

Detailed Description Of The Preferred Embodiments

Many embodiments of the present invention are technologically possible. It will be apparent to those of ordinary skill in the art from the present disclosure how to implement them. Embodiments of the inventive system, method, and medium will be described with reference to FIGS. 6, 7, 8, 9, 10, 11, and 12.

In a class of embodiments, the invention is a method for rendering an audio program indicative of at least one source, including by panning the source along a trajectory (relative to an assumed listener position), using an array of loudspeakers organized as a mesh (e.g., a two-dimensional mesh, or a three-dimensional mesh) of convex N-gons (typically, convex, planar N-gons). The mesh has faces, $F_i$, where i is an index in the range $1 \leq i \leq M$, M is an integer greater than 2, each face, $F_i$, is a convex (and typically, planar) polygon having $N_i$ sides, $N_i$ is any integer greater than 2, the number $N_i$ can vary from face to face but is greater than three for at least one of the faces, and each of the vertices of the mesh corresponds to the location of a different one of the loudspeakers. For example, the mesh may be a two-dimensional (2D) mesh or a three-dimensional (3D) mesh, where some of the mesh's faces are triangles and some of the mesh's faces are quadrilaterals. The mesh structure can be user defined, or can be computed automatically (e.g., by a Delaunay triangulation of the speaker positions or their convex hull to determine a mesh whose faces are triangles, followed by replacement of some of the triangular faces (determined by the initial triangulation) by non-triangular, convex (and typically, planar) N-gons).

In a class of embodiments, the invention is a method for rendering an audio program indicative of at least one source, including by panning the source along a trajectory comprising a sequence of source locations, using an array of speakers organized as a 2D or 3D mesh (e.g., a convex 3D mesh) whose faces are convex (and typically, planar) N-gons (where N can vary from face to face, and N is greater than three for at least one face of the mesh), where the mesh encloses the location of an assumed listener, said method including steps of:

(a) for each of the source locations, determining an intersecting face of the mesh, where the intersecting face includes the projection of the source location on the mesh, thereby determining, for each said intersecting face, a subset of the speakers whose positions coincide with the vertices of the intersecting face; and (b) determining gains to be applied to speaker feeds for each said subset of the speakers, to cause sound emitted from the subset of the speakers to be perceived as emitting from the corresponding source location.

For example, the mesh may be an improved version of the conventional mesh shown in FIG. 7. The mesh of FIG. 7 organizes seven speakers at the vertices of triangular faces T1, T2, T4, T5, and T6. The top edge of FIG. 7 corresponds to the front of the room which contains the seven speakers, the bottom edge corresponds to the back of the room, and the assumed listener position (the sweetspot) is the center of FIG. 7 (the center of the room). However, when implementing a pan (e.g., between the front right corner of the room and back left corner of the room), the pan may be unstable if the speakers are assumed to be organized in accordance with the FIG. 7 mesh.

In general, when implementing a pan there is a tradeoff between the following four desirable criteria: firing (i.e., driving) a minimal number of speakers close to the desired source location at any instant; stability (at a sweetspot); stability over a wide range of assumed listener positions (e.g., over a wide sweetspot); and timbral fidelity. If more speakers are fired simultaneously at each instant, the pan will be more stable, but will typically have worse timbral fidelity and worse stability over a wide sweetspot. Also, firing a consistent set of left-right symmetric speakers across a region is desirable.

In general, conventional determination of a mesh of speaker positions (to be assumed during implementation of a pan) by running a triangulation algorithm can lead to non-symmetrical left-right configurations, which are typically not desirable. For example, the conventionally determined mesh of FIG. 7 includes triangles T1 and T2, which do not have left-right symmetry. A source in triangle T2 would fire more speakers to the right of the sweetspot, while a source in triangle T1 would fire more speakers to the left. Thus, during a pan from the front right corner of the room to the back left corner (implemented in a conventional manner assuming the FIG. 7 mesh), there would be an undesirable sudden transition between a time interval (during the pan) in which more speakers to the right of the sweetspot are fired and a time interval (during the pan) in which more speakers to the left of the sweetspot are fired.

Thus, in accordance with an embodiment of the invention, the same seven speakers which are organized by the FIG. 7 mesh (in the same room) are assumed to be organized in accordance with the mesh shown in FIG. 8, rather than that of FIG. 7. In accordance with the FIG. 8 mesh, the speakers are organized at the vertices of triangular faces T4, T5, and T6, and planar quadrilateral face Q1. The top edge of FIG. 8 corresponds to the front of the room which contains the speakers, the bottom edge corresponds to the back of the room, and the assumed listener position is the center of FIG. 8 (the center of the room). When implementing a pan between the front right corner of the room and back left corner of the room, the pan will be more stable if the speakers are assumed (in accordance with an embodiment of the invention) to be organized in accordance with the FIG. 8 mesh, than if they are assumed to be organized in accordance with a conventional mesh (e.g., that of FIG. 7) whose faces are all triangles. This is because there will not be an undesirable sudden transition between a time interval (during the pan) in which more speakers to the right of the sweetspot are fired and a time interval (during the pan) in which more speakers to the left of the sweetspot are fired if the pan is implemented assuming that the speakers are organized in accordance with FIG. 8.

In other embodiments of the invention, a set of speakers which are not axis-aligned (and not symmetrically aligned with respect to the assumed position of the listener) are assumed to be organized in accordance with a mesh having at least one face which is non-triangular. For example, in one such embodiment a set of seven speakers which are not axis-aligned (and not symmetrically aligned with respect to the assumed position of the listener) are assumed to be organized in accordance with the mesh shown in FIG. 8A. In accordance with the FIG. 8A mesh, the speakers are organized at the vertices of triangular faces T40, T50, and T60, and planar quadrilateral face Q10. The top edge of FIG. 8A need not correspond to the front of the room which contains the speakers, and the bottom edge need not correspond to the back of the room.

In some embodiments, the mesh structure of the array of speakers is computed by triangulation of the speaker positions (or their convex hull) to determine an initial mesh whose faces are triangles (with the speaker positions coinciding with the triangle vertices), followed by replacement of at least one (e.g., more than one) of the triangular faces of the initial mesh by non-triangular, convex (and typically, planar) N-gons (e.g., quadrilaterals) with the speaker positions coinciding with the vertices of the N-gons. Faces of the initial mesh which are elongated triangles are not well suited to typical panning, and may be collapsed into quadrilaterals by removing edges shared with their neighbors from the initial mesh, resulting in a more uniform panning region.

Figure 1:
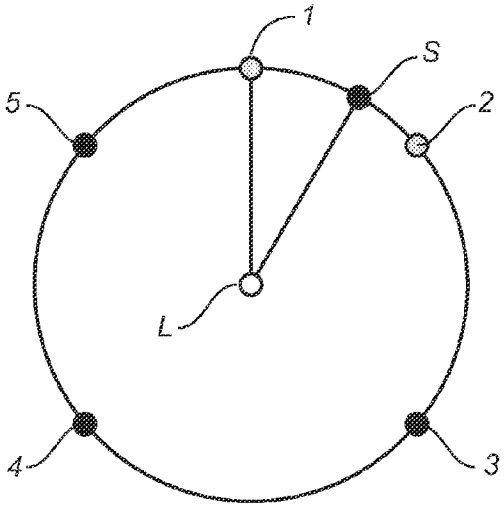
FIG. 1 (PRIOR ART)
FIG. 1 is a diagram of a one-dimensional (1D) mesh of speakers organized along a circle, of a type assumed by a conventional method for 2D sound panning.
Figure 2:
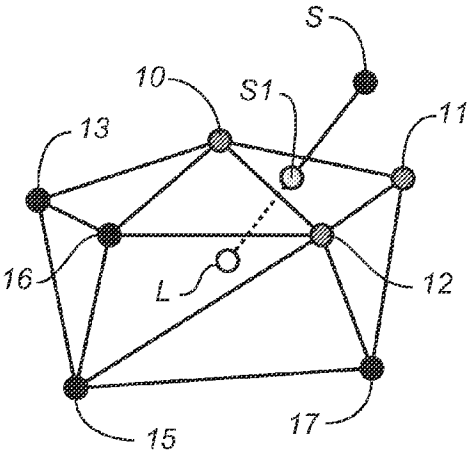
FIG. 2 (PRIOR ART)
FIG. 2 is a diagram of a three-dimensional (3D) triangular mesh of speakers, of a type assumed by a conventional direction-based method for 3D sound panning (e.g., a conventional direction-based VBAP method).

For example, such an initial triangulation of the positions of speakers 10, 11, 12, 13, 15, 16, and 17 (of FIG. 2) may determine the initial mesh shown in FIG. 2. The faces of this initial mesh consist of triangles, with the speaker positions coinciding with the vertices of the triangles. The initial mesh may be modified in accordance with one exemplary embodiment of the invention, to replace the triangular face having vertices 12, 15, and 16, and the triangular face having vertices 12, 15, and 17, by a planar, convex quadrilateral. Thus, the initial mesh may be modified to determine the inventive mesh of FIG. 6, which includes the planar, convex quadrilateral having vertices 12, 15, 16, and 17 in place of the two noted triangular faces (having vertices 12, 15, and 16, and vertices 12, 15, and 17) of FIG. 2. When implementing a pan between a location near to vertex 12 to a location near to vertex 15 of the speaker array of FIGS. 2 and 6, the pan will be more stable if the speakers are assumed to be organized in accordance with the FIG. 6 mesh, than if they are assumed to be organized in accordance with the conventional mesh of FIG. 2.

For another example, consider the conventional triangular mesh of speakers shown in FIG. 9. The mesh of FIG. 9 organizes nine speakers at the vertices of triangular faces T7, T8, T9, T10, T11, T12, T13, T14, and T5. The top edge of FIG. 9 corresponds to the front of the room which contains the nine speakers, the bottom edge corresponds to the back of the room, and the assumed listener position is the center of FIG. 9 (the center of the room). When implementing some pans (e.g., a pan from the location of front center speaker 60 to location 61 along the room's back wall), the pan may be unstable if the speakers are assumed to be organized in accordance with the FIG. 9 mesh. In contrast, the FIG. 9 mesh may be modified in accordance with an embodiment of the invention to determine the FIG. 10 mesh (e.g., by collapsing each triangular face having an angle less than some predetermined threshold angle, with an adjacent triangular face, to determine a quadrilateral face. Such elongated triangular faces are not well suited for implementing many typical pans, whereas such quadrilateral faces are well suited for implementing such pans). The mesh of FIG. 10 organizes the same nine speakers (which are organized by the FIG. 9 mesh) at the vertices of triangular faces T9, T12, and T14 (the same faces are those identically numbered in FIG. 9) and planar quadrilateral faces Q2, Q3, and Q4. The top edge of FIG. 10 corresponds to the front of the room which contains the nine speakers, the bottom edge corresponds to the back of the room, and the assumed listener position is the center of FIG. 10 (the center of the room). By assuming that the speakers are organized as the FIG. 10 mesh (rather than the conventional FIG. 9 mesh), typical pans can be implemented in an improved manner, since the faces of the FIG. 10 mesh are less elongated and have greater left-right symmetry.

To avoid unstable implementations (implementations which are perceived as being unstable) of a pan, e.g., along a diagonal source trajectory relative to a listener (e.g., where the speakers and listener are in a room, and the pan trajectory extends both toward the left (or right) of the room and the back (or front) of the room), some embodiments of the invention determine the mesh structure of the array of speakers as follows. An initial mesh structure of the array of speakers is computed by triangulation of the speaker positions (or their convex hull). The faces of the initial mesh (e.g., the mesh of FIG. 2) are triangles whose vertices coincide with the speaker positions. Then, a modified mesh (e.g., the mesh of FIG. 6) is determined from the initial mesh by replacing at least some of the triangular faces of the initial mesh by convex, non-triangular N-gons (e.g., quadrilaterals) whose vertices coincide with speaker positions. For example, triangular faces (of the initial mesh) that cover the left side and right side of the panning area/volume in a non-uniform manner may be merged into quadrilateral faces (or faces which are other non-triangular N-gons) that cover the left and right sides of the panning area/volume more uniformly. For example, for each triangle of the initial mesh, the area of the triangle which is to the left of the sweetspot (e.g., the center of the mesh bounding volume) can be computed and compared to the area of the triangle which is to the right of the sweetspot. If a triangle extends both to the left and right sides of the sweetspot, and the portion of its area to the left of the sweet spot is very different from the portion of its area to right of the sweet spot, then the triangle may be collapsed into a non-triangular N-gon which is more uniform with respect to the sweet spot.

In some embodiments, an array of speakers is assumed to be organized as a mesh whose vertices coincide with the speaker locations (during rendering of an audio program including by determining, for each source location, an intersecting face of the mesh which includes the projection of the source location on the mesh), but the structure of the mesh is not determined by modification of an initial mesh. Instead, the mesh is an initial mesh which includes at least one face which is a non-triangular, convex (and typically, planar) N-gon (e.g., a quadrilateral), with the vertices of the N-gon coinciding with speaker locations.

In typical embodiments of the invention, to render a pan of a sound source through a sequence of (2D or 3D) apparent source positions using an array of speakers organized as a mesh of polygons (polygonal faces), which includes at least one face which is a non-triangular, convex (and typically, planar) N-gon (whose vertices coincide with speaker positions), the contributing N-gon at any instant during the pan (the face of the mesh to be driven at such instant) is determined (e.g., by testing) to be the polygon of the mesh which satisfies the following criterion: a ray connecting an assumed listener position (e.g., sweetspot) to the target source position (at the instant) intersects the contributing N-gon or a region enclosed by the contributing N-gon. Typically, if a ray connecting an assumed listener position to a target source position intersects two of the faces of the mesh (i.e., the ray intersects an edge between two faces) at an instant, only one of these faces is selected as the contributing N-gon at the instant.

For example, to render a pan of a sound source using the speaker array of FIG. 6, the speakers may be assumed to be organized as the mesh of FIG. 6. To playback an audio program so that the sound emitted from the speaker array is perceived as emitting from an audio source at a source location outside the mesh (e.g., location "S2" in FIG. 6) relative to the listener (location "L" in FIG. 6), the face of the mesh which includes the projection (e.g., location "S3" in FIG. 6) of the source location on the mesh (e.g., the face intersected by the ray from listener location L to the source location S2) may be determined to be the contributing N-gon. Then, the gains to be applied to the speaker feeds for the speakers at the vertices of this face (e.g., speakers 10, 11, and 12 of FIG. 6) may be determined to cause the sound emitted from these speakers to be perceived as emitting from the source location. Similarly, to playback an audio program so that the sound emitted from the speaker array is perceived as emitting from an audio source at a source location inside the mesh (e.g., location "S4" in FIG. 6) relative to the listener, the face of the mesh which includes the projection (e.g., location "S5" in FIG. 6) of the source location on the mesh (i.e., the triangle intersected by the ray from the listener location L to the source location S4) may be determined to be the contributing N-gon. Then, the gains to be applied to the speaker feeds for the speakers at the vertices of this face (e.g., speakers 13, 15, and 16 of FIG. 6) may be determined to cause the sound emitted from these speakers to be perceived as emitting from the source location. Alternatively, to playback an audio program so that the sound emitted from the speaker array is perceived as emitting from an audio source at a source location (or sequence of source locations) inside the mesh relative to the listener, another subset (or sequence of subsets) of the speakers of the array of FIG. 6 may be determined in some other manner (e.g., to render sound to be perceived as emitting from source location S4, the subset consisting of speakers 13, 15, 16, 11, 12, and 17 may be selected), and gains to be applied to the speaker feeds for each selected subset of the speakers may then be determined.

For each vertex of each N-gon of the mesh which is selected to be a contributing N-gon (and thus for each speaker whose position coincides with one of these vertices), if the contributing N-gon is a planar N-gon, a gain is typically determined by computing the generalized barycentric coordinates with respect to the contributing N-gon of the target source point (i.e., of the intersection point of a ray, from the listener position to the target source point, and the contributing N-gon or a point within the contributing N-gon. The barycentric coordinates, $b_i$ (where i is an index in the range $1 \leq i \leq N$), or their powers (e.g., $b_i^2$), or renormalized versions thereof (to preserve power or amplitude), can be used as panning gains. Thus, if an object channel (of an object based audio program to be rendered) comprises a sequence of audio samples for each target source point, N speaker feeds can be generated (for rendering audio which is perceived as emitting from the target source point) from the sequence of audio samples. Each of the N speaker feeds may be generated by a process including application of a different one of the panning gains (e.g., a different one of the barycentric coordinates or a scaled version thereof) to the sequence of audio samples.

It is well known how to compute the generalized barycentric coordinates of a point with respect to a planar N-gon. A set of generalized barycentric coordinates of a point with respect to a planar N-gon must satisfy well known affine combination, smoothness, and convex combination requirements, as described (for example) in the paper Meyer, et al., "Generalized Barycentric Coordinates on Irregular Polygons," Journal of Graphics Tools, Vol. 7, Issue 1, November 2002, pp. 13-22).

If the contributing N-gon is a non-planar N-gon (e.g., a quadrilateral which is substantially planar but not exactly planar), a gain for each vertex of the contributing N-gon is similarly determined, e.g., by a variation on a conventional method of computing generalized barycentric coordinates, or by splitting the non-planar N-gon into planar N-gons or fitting a planar N-gon to it and then determining generalized barycentric coordinates for the planar N-gon(s). Preferably, the computation that determines each contributing N-gon would be robust to minor floating-point/arithmetic errors that would cause a contributing N-gon to be not exactly planar.

FIG. 11 is a diagram of an array of speakers including a layer of axis-aligned speakers 100, 101, 102, 103, 104, 105, and 106 (positioned on the floor of a room), and speakers 110, 111, 112, 113, 114, and 115 (which are positioned, as another layer of speakers, on the ceiling of the room and are not axis-aligned). In accordance with an embodiment of the invention, speakers 110-115 are organized as a convex, 3D mesh of speakers whose faces include triangular faces T20 and T21, quadrilateral face Q10, and other faces (not shown in FIG. 11).

In one exemplary embodiment of the invention, to render a pan of a sound source using the speaker array of FIG. 11, the speakers may be assumed to be organized as the mesh of FIG. 11. To playback an audio program so that the sound emitted from the speaker array is perceived as emitting from an audio source at a source location relative to an assumed listener position, the face of each layer of the mesh which includes the projection of the source location on said layer of the mesh may be determined to be the contributing N-gon. Then, the gains to be applied to the speaker feeds for the speakers at the vertices of each such face (e.g., speakers 110, 111, and 112 of FIG. 11 if the contributing face is T20, or speakers 112, 113, 114, and 115 of FIG. 11 if the contributing face is Q10) may be determined to cause the sound emitted from these speakers to be perceived as emitting from the source location.

In another exemplary embodiment of the invention, to render a pan of a sound source using the speaker array of FIG. 11, the speakers may be assumed to be organized as the mesh of FIG. 11. A dual-balance panning method of the type described above with reference to FIGS. 2, 3, and 4 may be employed to render a pan of a sound source in the plane of speakers 100, 101, 102, 103, 104, 105, and 106. To render a pan of a sound source in the plane of speakers 110, 111, 112, 113, 114, and 115, the face of the FIG. 11 mesh which includes the projection of the source location on the mesh (e.g., the face intersected by the ray from the assumed listener location to the source location) may be determined to be the contributing N-gon. Then, the gains to be applied to the speaker feeds for the speakers at the vertices of this face (e.g., speakers 110, 111, and 112 of FIG. 11 if the contributing face is T20, or speakers 112, 113, 114, and 115 of FIG. 11 if the contributing face is Q10) may be determined to cause the sound emitted from these speakers to be perceived as emitting from the source location.

In one exemplary embodiment, to render a pan along a 3D trajectory within the FIG. 11 mesh having a first portion along the ceiling, and a second portion which is an arbitrary 3D path within the mesh toward the line on the floor which connects speakers 104 and 105, the rendering system could first pan through subsets of ceiling speakers 110, 111, 112, 113, 114, and 115 in the manner described in the previous paragraph (i.e., to render sound using a sequence of subsets of only the ceiling speakers 110-115) until an inflection point (a specific distance away from speaker 101 toward the line between speakers 104 and 105) is reached. Then, panning steps (e.g., a variation on a method described above with reference to FIGS. 3-5) could be performed to determine a sequence of gains which in turn determine a sequence of blends of subsets of ceiling speakers 110-115 and subsets of lower speakers 100-106, to continue the pan (so that the source is perceived as dipping downward as it moves to the line on the floor which connects speakers 104 and 105).

In another class of embodiments, the invention is a method for rendering an audio program indicative of at least one source, including by generating speaker feeds for causing an array of loudspeakers to pan the source along a trajectory comprising a sequence of source locations, said method including steps of:

(a) determining a 3D mesh whose faces, $F_i$, are convex N-gons, where positions of the N-gons' vertices correspond to locations of the loudspeakers, i is an index in the range $1 \leq i \leq M$, M is an integer greater than 2, each of the faces, $F_i$, is a convex polygon having $N_i$ sides, $N_i$ is any integer greater than 2, and $N_i$ is greater than 3 for at least one of the faces (such a 3D mesh is a polyhedron whose vertices correspond to locations of the speakers); and (b) determining a sequence of vertex subsets of the vertices of the 3D mesh (each of such vertex subsets determines either a polyhedron whose faces are convex N-gons and whose vertices correspond to locations of a subset of the speakers, or it determines one of the polygonal faces of the 3D mesh), where each of the subsets encloses (surrounds) one of the source locations or is or includes a polygonal face which is intersected by a ray from the assumed listener position to one of the source locations, and determining a set of gains for each subset of the loudspeakers whose locations correspond to positions of the vertices of a vertex subset in the sequence of vertex subsets of the vertices of the 3D mesh.

In some embodiments, step (a) includes steps of: determining an initial mesh whose faces are triangular faces, wherein the positions of the vertices of the triangular faces correspond to the locations of the loudspeakers; and replacing at least two of the triangular faces of the initial mesh by at least one replacement face which is a non-triangular, convex N-gon, thereby generating the 3D mesh. In some embodiments, the gains determined in step (b) for said each subset of the loudspeakers (whose locations correspond to positions of the vertices of a vertex subset in the sequence of vertex subsets) are generalized barycentric coordinates of one of the source locations, with respect to the vertices of the corresponding vertex subset.

In typical embodiments, the inventive system is or includes a general or special purpose processor (e.g., an implementation of processing subsystem 501 of FIG. 12) programmed with software (or firmware) and/or otherwise configured to perform an embodiment of the inventive method. In other embodiments, the inventive system is implemented by appropriately configuring (e.g., by programming) a configurable audio digital signal processor (DSP) to perform an embodiment of the inventive method. The audio DSP can be a conventional audio DSP that is configurable (e.g., programmable by appropriate software or firmware, or otherwise configurable in response to control data) to perform any of a variety of operations on input audio data.

In some embodiments, the inventive system is or includes a general purpose processor, coupled to receive input audio data (indicative of an audio program) and coupled to receive (or configured to store) speaker array data indicative of the positions of speakers of a speaker array, and programmed to generate output data indicative of gain values and/or speaker feeds in response to the input audio data and the speaker array data by performing an embodiment of the inventive method. The processor is typically programmed with software (or firmware) and/or otherwise configured (e.g., in response to control data) to perform any of a variety of operations on the input data, including an embodiment of the inventive method. In typical implementations, the system of FIG. 12 is an example of such a system. The FIG. 12 system includes processing subsystem 501 (which in one implementation is a general purpose processor) which is programmed to perform any of a variety of operations on input audio data, including an embodiment of the inventive method. The input audio data is indicative of an audio program. Typically, the audio program is an object based audio program comprising a set of one or more object channels (and optionally also at least one speaker channel), each comprising audio samples, and metadata indicative of at least one trajectory of at least one audio object (source) which emits sound indicated by audio samples of at least one object channel.

The system of FIG. 12 also includes input device 503 (e.g., a mouse and/or a keyboard) coupled to processing subsystem 501 (sometimes referred to as processor 501), storage medium 504 coupled to processor 501, display device 505 coupled to processor 501, speaker feed generation subsystem 506 (labeled "rendering system" in FIG. 12) coupled to processor 501, and speakers 507. Subsystem 506 is configured to generate, in response to the input audio and a sequence of gain values generated by processor 501 in response to the input audio, speaker feeds for driving speakers 507 (e.g., to emit sound indicative of a pan of at least one source indicated by the input audio) or data indicative of such speaker feeds.

For example, in the case that the input audio is indicative of an object based audio program, including an object channel comprising a sequence of audio samples for each source position (of a sequence of source positions along a trajectory indicated by metadata of the object based audio program), subsystem 506 may be configured to generate N speaker feeds (for driving an N-speaker subset of speakers 507 to emit sound which is perceived as emitting from one said source point) from the sequence of audio samples for each source position. Subsystem 506 may be configured to generate each of the N speaker feeds (for each source position) by a process including application of a different one of N gains determined by processor 501 for the N-gon face of the mesh which corresponds to the source position (i.e., the face intersected by a ray from the assumed listener position to the source position), to the sequence of audio samples for the source position. In some embodiments, the N gains (a set of N gain values) determined by processor 501 for each source position may be the barycentric coordinates (or a scaled version of the barycentric coordinates) of the source position relative to the vertices of the N-gon face of the mesh which corresponds to the source position.

Processor 501 is programmed generate gain values (for assertion to subsystem 506) for enabling subsystem 506 to generate the speaker feeds for driving speakers 507, with the assumption that speakers 507 are organized as a mesh of convex (and typically, planar) N-gons. Processor 501 is programmed to determine (in accordance with an embodiment of the inventive method) the mesh of convex N-gons, in response to data indicative of the positions of speakers 507 and data indicative of an assumed position of a listener (relative to the positions of speakers 507). Processor 501 is programmed to implement the inventive method in response to instructions and data (e.g., data indicative of the positions of speakers 507) entered by user manipulation of input device 503, and/or instructions and data otherwise provided to processor 501. Processor 501 may implement a GUI or other user interface, including by generating displays of relevant parameters (e.g., mesh descriptions) on display device 505. In some embodiments, processor 501 may determine the mesh of N-gons and the assumed listener position (relative to the positions of speakers 507) in response to entered data indicative of the positions of speakers 507.

In some implementations processing subsystem 501 and/or subsystem 506 of the FIG. 12 system is an audio digital signal processor (DSP) which is operable to generate gain values for generating speaker feeds, and/or data indicative of speaker feeds, and/or speaker feeds, in response to input audio (and data indicative of the positions of speakers 507.

Computer readable storage medium 504 (e.g., an optical disk or other tangible object) has computer code stored thereon that is suitable for programming processor 501 to perform an embodiment of the inventive method. In operation, processor 501 executes the computer code to process data indicative of input audio (and data indicative of the positions of speakers 507) in accordance with the invention to generate output data indicative of gains to be employed by subsystem 506 to generate speaker feeds for driving speakers 507 to image at least one sound source (indicated by the input audio), e.g., as the source pans along a trajectory indicated by metadata including in the input audio.

Aspects of the invention are a computer system programmed to perform any embodiment of the inventive method, and a computer readable medium which stores computer-readable code for implementing any embodiment of the inventive method.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for rendering an audio program indicative of at least one source, including by generating speaker feeds for causing an array of speakers to pan the source along a trajectory comprising a sequence of source locations, said method comprising:

determining an initial mesh using triangulation of locations of the speakers of the array of speakers; wherein faces of the initial mesh are triangular faces, wherein the positions of the vertices of the triangular faces correspond to the locations of the speakers;

determining a mesh whose faces, $F_i$, are convex N-gons, where positions of the vertices of the N-gons correspond to locations of the speakers, i is an index in the range $1 \leq i \leq M$, M is an integer greater than 2, each of the faces, $F_i$, is a convex polygon having $N_i$ sides, $N_i$ is any integer greater than 2, and $N_i$ is greater than 3 for at least one of the faces; wherein determining the mesh comprises replacing at least two of the triangular faces of the initial mesh by at least one replacement face which is a non-triangular, convex N-gon, thereby generating the mesh, such that the mesh exhibits a greater left-right symmetry and/or such that faces of the mesh are less elongated than faces of the initial mesh; wherein the replacing comprises removing edges which are shared by the at least two of the triangular faces; and for each of a plurality of source locations of the sequence of source locations:

determining a projection of the source location on a face of the mesh;

determining gains for a subset of the speakers of the array of speakers whose locations correspond to the positions of the vertices of the face of the mesh; and generating speaker feeds for the subset of the speakers, including by applying the gains for the subset of the speakers to audio samples of the audio program.

2. The method of claim 1, wherein the faces of the mesh include at least one triangular face and at least one quadrilateral face.

3. The method of claim 1, wherein the faces of the mesh include at least one triangular face and at least one planar, quadrilateral face.

4. The method of claim 1, wherein each of the faces of the mesh is a convex, planar polygon, and, for each of the plurality of source locations of the sequence of source locations, the method further comprises:

determining generalized barycentric coordinates of the projection of the source location on the face of the mesh, with respect to the vertices of the face on which the source location is projected.

5. The method of claim 4, wherein the gains for the subset of the speakers of the array of speakers are the generalized barycentric coordinates of the projection of the source location on the face of the mesh, with respect to the vertices of the face on which the source location is projected and which corresponds to the subset of the speakers of the array of speakers.

6. The method of claim 1, wherein the faces of the mesh correspond to locations of speakers of the array of speakers in a first plane, wherein the array of speakers further comprises speakers in a second plane, wherein, for one or more of the source locations of the sequence of source locations, the method further comprises:

determining gains for a subset of the speakers of the array of speakers in the second plane;

blending the gains for the subset of speakers of the array of speakers in the first plane and the subset of speakers of the array of speakers in the second plane; and generating speaker feeds for a blend of the subset of the speakers in the first plane and the subset of speakers in the second plane, including by applying the blended gains to audio samples of the audio program.

7. A system for rendering an audio program indicative of at least one source and a trajectory for the source, including by generating speaker feeds for panning the source along the trajectory using an array of speakers, wherein the trajectory comprises a sequence of source locations, said system including:

a processing subsystem coupled to receive data indicative of the audio program and configured to:

determine an initial mesh using triangulation of locations of the speakers of the array of speakers; wherein faces of the initial mesh are triangular faces, wherein the positions of the vertices of the triangular faces correspond to the locations of the speakers; and determine a mesh whose faces, $F_i$, are convex N-gons, where positions of the vertices of the N-gons correspond to locations of the speakers, i is an index in the range $1 \leq i \leq M$, M is an integer greater than 2, each of the faces, $F_i$, is a convex polygon having $N_i$ sides, $N_i$ is any integer greater than 2, and $N_i$ is greater than 3 for at least one of the faces, wherein determining the mesh comprises replacing at least two of the triangular faces of the initial mesh by at least one replacement face which is a non-triangular, convex N-gon, such that the mesh exhibits a greater left-right symmetry and/or such that faces of the mesh are less elongated than faces of the initial mesh, thereby generating the mesh; wherein the replacing comprises removing edges which are shared by the at least two of the triangular faces; and for each of a plurality of source locations of the sequence source locations:

determine a projection of the source location on a face of the mesh in response to the data indicative of the audio program;

determine gain values for a subset of the speakers of the array of speakers whose locations correspond to the positions of the vertices of the face of the mesh; and a speaker feed generation subsystem coupled and configured to generate the speaker feeds in response to the data indicative of the audio program and the gain values.

8. The system of claim 7, wherein the faces of the mesh include at least one triangular face and at least one quadrilateral face.

9. The system of claim 7, wherein the faces of the mesh include at least one triangular face and at least one planar, quadrilateral face.

10. The system of claim 7, wherein at least the processing subsystem is implemented as an audio digital signal processor.

11. The system of claim 7, wherein the processing subsystem is a general purpose processor that has been programmed to generate the gain values in response to the data indicative of the audio program.

12. The system of claim 7, wherein each of the faces of the mesh is a convex, planar polygon, and, for each of the plurality of source locations of the sequence of source locations, the processing subsystem is further configured to determine generalized barycentric coordinates of the projection of the source location on the face of the mesh, with respect to the vertices of the face on which the source location is projected.

13. The system of claim 12, wherein the gain values for the subset of the speakers of the array of speakers are the generalized barycentric coordinates of the projection of the source location on the face of the mesh, with respect to the vertices of the face on which the source location is projected and which corresponds to the subset of the speakers of the array of speakers.

14. The system of claim 7, wherein the faces of the mesh correspond to locations of speakers of the array of speakers in a first plane, wherein the array of speakers further comprises speakers in a second plane, wherein, for one or more of the source locations of the sequence of source locations, the processing system is further configured to:

determine gain values for a subset of the speakers of the array of speakers in the second plane; and blend the gain values for the subset of speakers of the array of speakers in the first plane and the subset of speakers of the array of speakers in the second plane; and wherein the speaker feed generation subsystem is further configured to generate speaker feeds for a blend of the subset of the speakers in the first plane and the subset of speakers in the second plane in response to the data indicative of the audio program and the blended gain values.

15. A non-transitory storage medium containing computer-readable instructions, which, when performed by one or more processors, cause an apparatus to implement a method for rendering an audio program indicative of at least one source, including by generating speaker feeds for causing an array of speakers to pan the source along a trajectory comprising a sequence of source locations, said method comprising:

determining an initial mesh using triangulation of locations of the speakers of the array of speakers; wherein faces of the initial mesh are triangular faces, wherein the positions of the vertices of the triangular faces correspond to the locations of the speakers;

determining a mesh whose faces, $F_i$, are convex N-gons, where positions of the vertices of the N-gons correspond to locations of the speakers, i is an index in the range $1 \leq i \leq M$, M is an integer greater than 2, each of the faces, $F_i$, is a convex polygon having $N_i$ sides, $N_i$ is any integer greater than 2, and $N_i$ is greater than 3 for at least one of the faces; wherein determining the mesh comprises replacing at least two of the triangular faces of the initial mesh by at least one replacement face which is a non-triangular, convex N-gon, thereby generating the mesh, such that the mesh exhibits a greater left-right symmetry and/or such that faces of the mesh are less elongated than faces of the initial mesh; wherein the replacing comprises removing edges which are shared by the at least two of the triangular faces; and for each of a plurality of source locations of the sequence of source locations:

determining a projection of the source location on a face of the mesh;

determining gains for a subset of the speakers of the array of speakers whose locations correspond to the positions of the vertices of the face of the mesh; and generating speaker feeds for the subset of the speakers, including by applying the gains for the subset of the speakers to audio samples of the audio program.

16. The medium of claim 15, wherein the faces of the mesh include at least one triangular face and at least one quadrilateral face.

17. The medium of claim 15, wherein the faces of the mesh include at least one triangular face and at least one planar, quadrilateral face.

18. The medium of claim 15, wherein each of the faces of the mesh is a convex, planar polygon, and, for each of the plurality of source locations of the sequence of source locations, the method further comprises:

determining generalized barycentric coordinates of the projection of the source location on the face of the mesh, with respect to the vertices of the face on which the source location is projected.

19. The medium of claim 18, wherein the gains for the subset of the speakers of the array of speakers are the generalized barycentric coordinates of the projection of the source location on the face of the mesh, with respect to the vertices of the face on which the source location is projected and which corresponds to the subset of the speakers of the array of speakers.

20. The medium of claim 15, wherein the faces of the mesh correspond to locations of speakers of the array of speakers in a first plane, wherein the array of speakers further comprises speakers in a second plane, wherein, for one or more of the source locations of the sequence of source locations, the method further comprises:

determining gains for a subset of the speakers of the array of speakers in the second plane;

blending the gains for the subset of speakers of the array of speakers in the first plane and the subset of speakers of the array of speakers in the second plane; and generating speaker feeds for a blend of the subset of the speakers in the first plane and the subset of speakers in the second plane, including by applying the blended gains to audio samples of the audio program.

* * * * *